US005802418A

United States Patent [19]

Nemoto et al.

[11] Patent Number: 5,802,418

[45] Date of Patent: Sep. 1, 1998

[54] SOLUTION MANUFACTURING APPARATUS

[75] Inventors: Kazuhiro Nemoto; Teruo Kashino, both of Hino, Japan

[73] Assignee: Konica Corporation, Japan

[21] Appl. No.: 786,043

[22] Filed: Jan. 21, 1997

[30] Foreign Application Priority Data

| | | | |
|---|---|---|---|
| Jan. 26, 1996 | [JP] | Japan | 8-011895 |
| Mar. 26, 1996 | [JP] | Japan | 8-070326 |
| Mar. 29, 1996 | [JP] | Japan | 8-077686 |

[51] Int. Cl.[6] ..... G03D 3/02

[52] U.S. Cl. ..... 396/627; 396/630; 396/636

[58] Field of Search ..... 396/626, 630, 396/627, 636, 641; 430/398, 399, 400

[56] References Cited

U.S. PATENT DOCUMENTS

| | | | |
|---|---|---|---|
| 5,508,777 | 4/1996 | Isokawa et al. | 396/626 |
| 5,587,760 | 12/1996 | Kurata et al. | 396/626 |

FOREIGN PATENT DOCUMENTS

| | | | |
|---|---|---|---|
| 5-131127 | 5/1993 | Japan | 396/942 |
| 7-128833 | 5/1995 | Japan | 396/942 |
| 8-95206 | 4/1996 | Japan | 396/942 |

*Primary Examiner*—D. Rutledge

*Attorney, Agent, or Firm*—Jordan B. Bierman; Bierman, Muserlian and Lucas

[57] ABSTRACT

In an apparatus for dissolving solid processing agent for photographic light-sensitive material in a dissolving tank in which a collecting section for collecting a supplied solid processing agent and a guide member for guiding the supplied solid processing agent to the collecting section, the apparatus comprises a pump for circulating the solution from a suction port and to a jetting port. The jetting port is arranged at a position corresponding to the collecting section so that the solution is jetted toward the solid processing agent collected by the collecting section.

6 Claims, 19 Drawing Sheets

SOLUTION MANUFACTURING APPARATUS

BACKGROUND OF THE INVENTION

The present invention relates to a solution manufacturing apparatus suitable for manufacturing a solution such as a photographic developing solution or a fixing solution, and specifically to a solution manufacturing apparatus which dissolves a solid substance supplied into a dissolution tank by causing liquid in the dissolution tank to pass a solid substance separation filter for circulating.

The above-mentioned conventional solution manufacturing apparatus stirs liquids inside the dissolution tank and promote to dissolve solid substances by providing a circulation pipe from the bottom of the dissolution tank, curving aforesaid jetting port at the end of the circulation pipe and jetting out horizontally the circulating liquid from the jetting port. Compared to a solution manufacturing apparatus which promotes the dissolution of the solid substance by providing stirring vanes in the dissolution tank for promoting the dissolution of the solid substance, there are merits in that the apparatus is constituted more compactly and the solution is less likely to be oxidized and deteriorated.

However, the above-mentioned circulation-type solution manufacturing apparatus has been used mainly for dissolving relatively big solid substance such as a tablet one by one. When smaller but more numerous solid substances are dissolved at once, specifically, compared to the stirring vane-type solution manufacturing apparatus, there is a problem that it is excessively time-consuming for the dissolution of the solid substance since sediment easily occurs from the rising of the circulation pipe inside the dissolution tank to the around of the jetting port.

SUMMARY OF THE INVENTION

The present invention is attained for solving the above-mentioned problems. An object of the present invention is to provide a circulation-type solution manufacturing apparatus wherein plural numbers of solid substances are simultaneously dissolved in a short time (it goes without saying that the solid substance is dissolved one by one), the apparatus is constituted compactly and the solution is not likely to be oxidized and deteriorated.

An object of the present invention can be attained by the following constitution.

(Constitution 1) A solid processing agent dissolution apparatus which dissolves a solid processing agent for photographic light-sensitive material comprising:

(a) a dissolution tank for dissolving the above-mentioned solid processing agent;

(b) a supplying port for supplying the above-mentioned solid processing agent to the above-mentioned dissolution tank;

(c) an accumulation area which is provided inside the above-mentioned dissolution tank and which accumulates the above-mentioned solid processing agent supplied from the above-mentioned supplying port;

(d) an introduction member which introduces the above-mentioned solid processing agent to the above-mentioned accumulation area; and (e) to have a circulation means for circulating the dissolved solution in the above-mentioned dissolution tank and to have jetting port for jetting the dissolution solution in such a manner that it is brought into contact with the above-mentioned solid processing agent accumulated in the above-mentioned accumulated area by the above-mentioned supplying means.

(Constitution 2) In a solution manufacturing apparatus which causes liquid in the dissolution tank to circulate through a solid substance separation filter and dissolves the solid substance supplied in the dissolution tank, the present invention provides a temperature-adjusting means which is in contact with circulating liquid fed to the dissolution tank through the solid substance separation filter which adjusts the temperature of the circulating liquid. (Constitution 3) On the interior surface below the liquid surface of the dissolution tank, jetting ports which jet the above-mentioned circulating liquid are provided. (Constitution 4) A temperature-adjusting means which is in contact with circulating liquid fed into the dissolution tank through the solid substance separation filter and adjusts the temperature of circulating liquid is provided and jetting ports which jet out the circulating liquid are provided on the side surface below the liquid level of the dissolution tank. (Constitution 5) An inclined solid substance separation filter (hereinafter, simply referred to as "an inclined filter") which, in liquid, is parallel to the inclined bottom of the dissolution tank is provide, and jetting ports which jet out the above-mentioned circulating liquid are provided on the side surface below the liquid level of the dissolution tank as well. (Constitution 6) Concurrently with providing a temperature-adjusting means which contacts circulating liquid fed to the dissolution tank through the solid substance separation filter and adjusts the temperature of circulating liquid and providing an inclined solid substance separation filter which, in liquid, is inclined perpendicular to the bottom of the dissolution tank, jetting ports which jet out the above-mentioned circulating liquid are provided on the side surface below the liquid level of the dissolution are provided.

The circulation-type solution manufacturing apparatus of Constitution 2 can adjust temperature of the circulating liquid at a level where the solid substance dissolves within a short time due to a temperature-adjusting means. Aforesaid temperature-adjusting means is provided in such a manner that it contacts the circulating liquid before it passes the solid substance separation filter and is fed into the dissolution tank. Therefore, the temperature of the circulating liquid can be maintained at a uniform level. Even if the temperature-adjusting means possesses numerous parallel heat-transfer fins having enlarged area in contact with the circulating liquid and a path for the circulating liquid, there is no fear to cause deformation of the solid substance due to excessive heating or shortening of life of the temperature-adjusting means due to clogging by the solid substance or collision. Therefore, the solid substance can be dissolved stably, effectively and rapidly. The circulation-type solution manufacturing apparatus of Constitution 3 provides jetting ports which jet out the circulating liquid on the side surface below the liquid level in the dissolution tank, and the circulation pipes do not protrude into the dissolution tank. Accordingly, sediment is less likely to occur in the liquid in the dissolution tank. The liquid effectively effects the solid substance so that aforesaid solid substance can be dissolved in a short time.

The circulation-type solution manufacturing apparatus of Constitution 4 provides both of the above-mentioned temperature-adjusting means and jetting ports. Therefore, the solid substance can further effectively be dissolved. The circulation-type solution manufacturing apparatus of Constitution 5 provides the above-mentioned jetting ports, and in addition, undissolved solid substance is cumulated by sliding along the surface of the inclined filter. Therefore, the circulating liquid is further effectively effected to the undissolved solid substance so that the solid substance can be dissolved in a still shorter time. The circulation-type solution manufacturing apparatus of Constitution 6 provides the above-mentioned jetting ports and the above-mentioned inclined filter. In addition, the above-mentioned temperature-adjusting means is provided. Accordingly, the solid substance can be dissolved in a short time further effectively.

Due to adding either a constitution in which jetting ports approximately horizontally jet out the circulating liquid, a constitution in which plural jetting ports are provided, a constitution in which at least one of jetting ports is provided where the solid substance is cumulated after sliding along the inclination of the bottom of the dissolution tank or a constitution in which there is a horizontal height between each of plural jetting ports to the above-mentioned solution manufacturing apparatus in which the jetting ports of the circulating liquid open on the side surface of the dissolution tank, the liquid further effectively effects to the solid substance, enabling it to be dissolved in a short time.

In the above-mentioned solution manufacturing apparatus wherein an inclined filter is provided in the dissolution tank and a jetting port opens its mouth on the side wall of the dissolution tank, in addition, a jetting port is provided on the side wall of the bottom of the dissolution tank where solid substance sliding along the surface of the inclined filter is cumulated. Due to a structure in which either a constitution in which the circulating liquid jets out approximately horizontally and parallel to the surface of the inclined filter, a constitution in which jetting ports are provided in such a manner that the above-mentioned circulating liquid jetting out to the facing both side walls each other intract in the above-mentioned dissolution tank or a constitution in which there is a gap between the bottom surface of the dissolution tank and the inclined filter and the jetting port is provided on the side wall of the dissolution tank compared to aforesaid gap so that the circulating liquid is jeted out approximately horizontally and parallel to the surface of the inclined filter, the liquid further effectively effects the solid substance so that the solid substance can be dissolved in a short time.

Due to a structure that the above-mentioned solution manufacturing apparatus is provided with either of a constitution in which a solution tank which in connected to the dissolution tank through a solid substance separation filter for circulating liquid in the dissolution tank and the circulating liquid is circulated through a solution tank, a constitution in which the jetting speed of the circulating liquid from the jetting port is controlled in such a manner that it is high speed when the solid substance is dissolved and it is low speed at the other time and a constitution in which completion of the dissolution of the solid substance is sensed due to the diluted substance density of the circulating liquid and the jetting speed is controlled based on the sensed information, the liquid further effectively effects the solid substance so that the solid substance can be dissolved in a short time.

In addition, the solution manufacturing apparatus for solving the above-mentioned problems has a light-sensitive material supplying apparatus comprising:

a rigid package housing a light-sensitive material processing agent and an open surface capable of being opened;

a tank wherein the above-mentioned upper portion is opened and the light-sensitive material processing agent inside the above-mentioned package is supplied through the above-mentioned open surface;

a guide which is located above the open surface of aforesaid tank and which extends approximately horizontally;

sliders which engage to aforesaid guide oscillably; a table composed of the first table provided on aforesaid slider and capable of rotating upward from the above-mentioned sliders and the second table provided rotatably along a side of aforesaid first table opposite to a side on the tank sidewherein the above-mentioned package is engaged on the above-mentioned second table and the package setting portion which prohibits movement other than the above-mentioned tank direction on the second table plane;

a lock mechnism which prohibits rotation of the above-mentioned second table on the above-mentioned first table; and locj releasing mechanism which releases the above-mentioned lock mechanism when the above-mentioned table arrives at a prescribed position of the above-mentioned guide.

Here, the operation of the above-mentioned constitution will be explained. First, at the initial status, the table is located above the tank. The table is moved along the guide in a direction in which the table is removed from the tank.

When the table arrives at a prescribed position of the guide during movement of the table, the lock mechanism is released by means of the lock releasing mechanism so that the second table can be rotatable.

The second table is cause to rotate downward. The package is set on the package setting portion on the second table in such a manner that the open surface of the package faces upward, and then conduct opening operation.

When the opening operation is finished, the second table is returned approximately horizontal status. Then, the lock releasing mechanism operates so that the lock mechanism becomes lock status and the rotation of the second table is prohibited.

Further, when the table is totally rotated upward, the light-sensitive material processing agents inside the package is supplied into the tank.

When supplying of the light-sensitive material processing agents is completed, the table is caused to return to approximately horizontal status, and the table is caused to return to the initial status.

Owing to the above-mentioned constitution, the second table rotates downward from the first table. Due to a structure in which the package is set onto the package setting portion on the second table in such a manner that the open portion faces upward, opening operation become stabilized and there is no fear that the light-sensitive material processing agents do not splash.

In addition, the lock releasing mechanism does not release the lock mechanism unless the table moves to the prescribed position and thereby the package cannot be set. Therefore, erroneous operation can be prevented.

Here, it is preferable that the above-mentioned package is composed of several kinds having different sizes each other and that the above-mentioned table is composed of the package setting portion which corresponds to each package.

In addition, it is also preferable that a member which prohibits movement of the above-mentioned package to the above-mentioned tank direction is mounted on the above-mentioned table.

Owing to providing aforesaid member, the table is caused to rotate upward, and when the light-sensitive material processing agents in the package are supplied to the tank, supplying of the package into the tank can be prevented.

In addition, it is also preferable to provide a crushing mechanism which crushes the package after the light-sensitive material processing agents have been supplied and also to provide an operAtion mechanism which operates aforesaid crushing mechanism in synchronous with movement of the above-mentioned slider to the above-mentioned tank side.

Owing to aforesaid crushing mechanism, the package is crushed after the light-sensitive material processing agents have been supplied so that the apparatus can be compact. Storage space for the packages can be saved. In addition, it is not necessary to convey aforesaid package to the out of the operation room. Accordingly, post processing of the package becomes easy.

Aforesaid crushing mechanism can be operated under the following timing. However, the present invention is not limited thereto. (1) The crushing mechanism is operated when the table is returned to the initial position. When the table is drawn next time, the package is collected. (2) When the table is drawn from the initial position, the crushing mechanism is operated so that the package supplied previously is crushed to be collected.

BRIEF DESCRIPTION OF THE DRAWINGS

FIG. 2(*b*) is a top view of a solution preparation apparatus in FIG. 2(*a*).

FIG. 3(*b*) is a top view of a solution preparation apparatus in FIG. 3(*a*).

FIG. 4(*b*) is a top view of a solution preparation apparatus in FIG. 4(*a*).

FIG. 5(*b*) is a top view of a solution preparation apparatus in FIG. 5(*a*).

FIG. 6(*b*) is a top view of FIG. 6(*a*).

DETAILED DESCRIPTION OF THE PREFERRED EMBODIMENT

Figure 1:
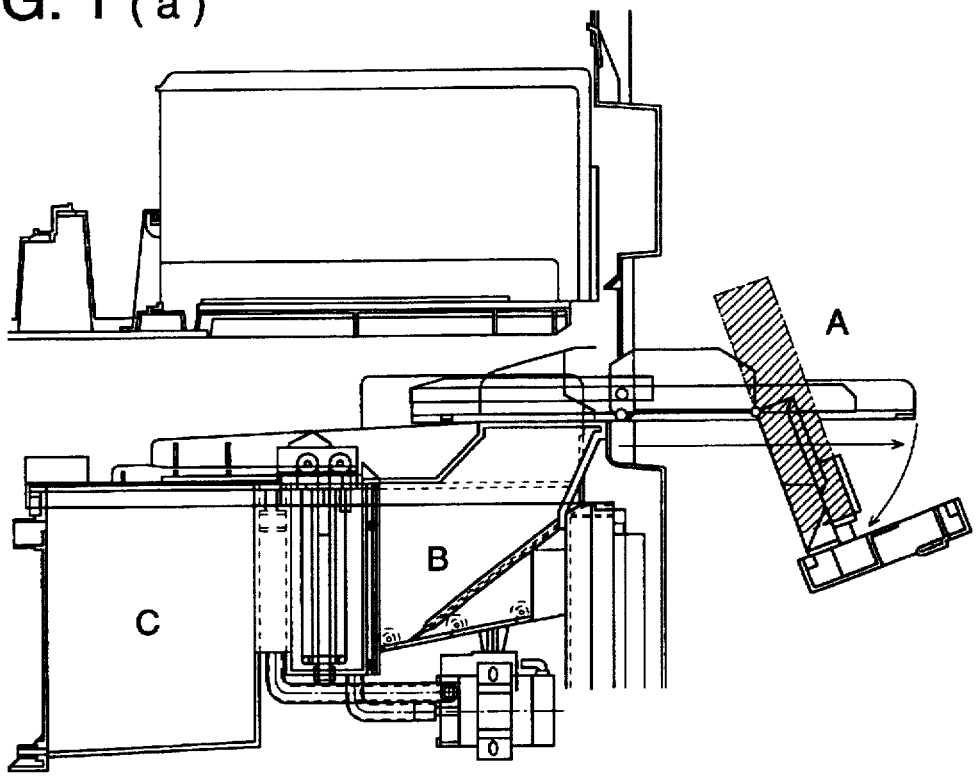
FIGS. 1(*a*) and 1(*b*) are a schematic cross sectional view showing an example of a solution manufacturing apparatus of the present invention.
Figure 1:
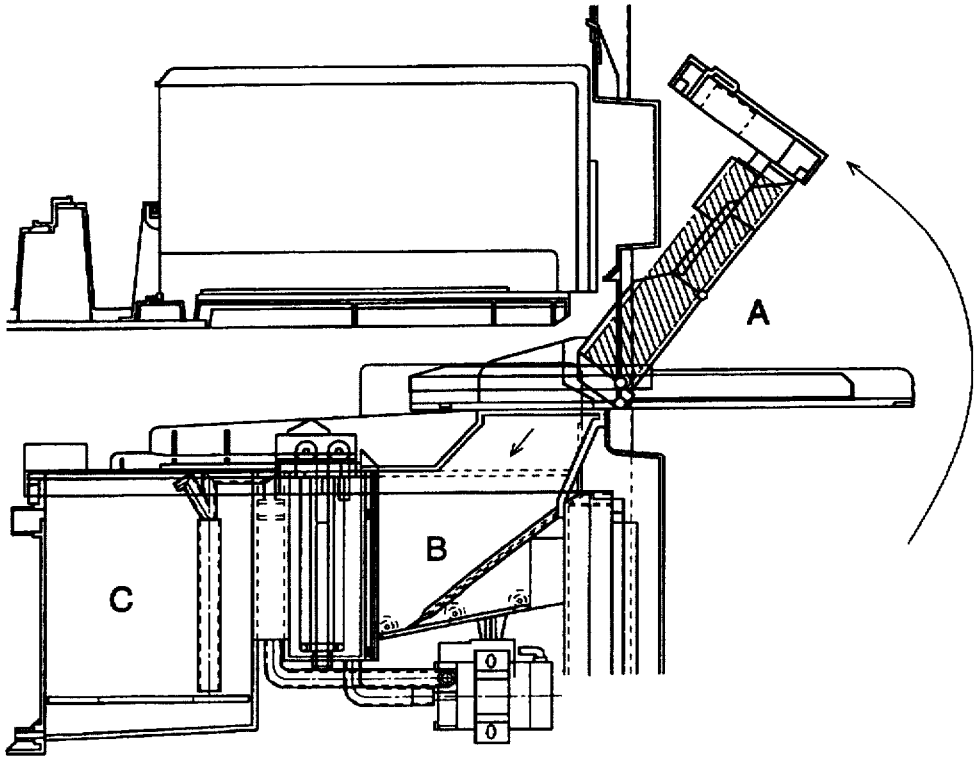

FIGS. 1(*a*) and 1(*b*) shows schematic block diagram of the solution manufacturing apparatus of the present invention. FIG. 1(*a*) shows a status when processing agents are loaded to supplying device A and FIG. 1(*b*) shows a status when the loaded processing agents are supplied to preparation apparatus B from supplying apparatus A. The processing solution prepared in preparation apparatus B is stored in replenisher tank C. Details of supplying section A and preparation apparatus B will be described in detail later.

Figure 2:
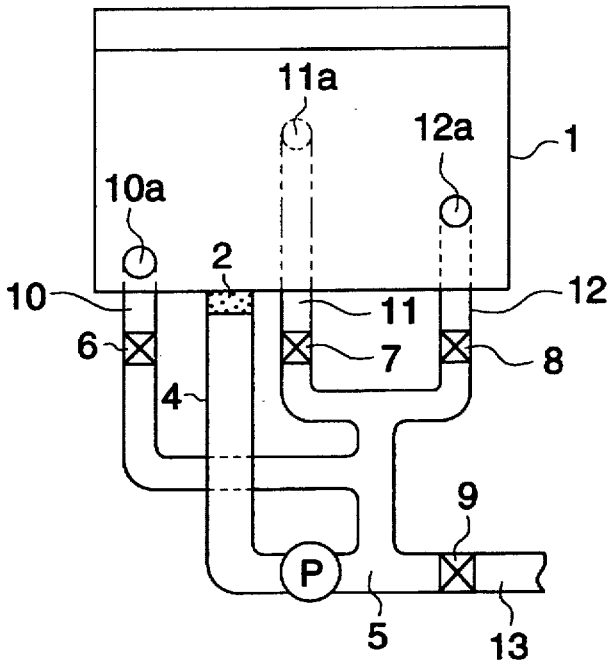
FIG. 2(*a*) is a schematic cross sectional view showing another example of a solution preparation apparatus of the present invention.
Figure 2:
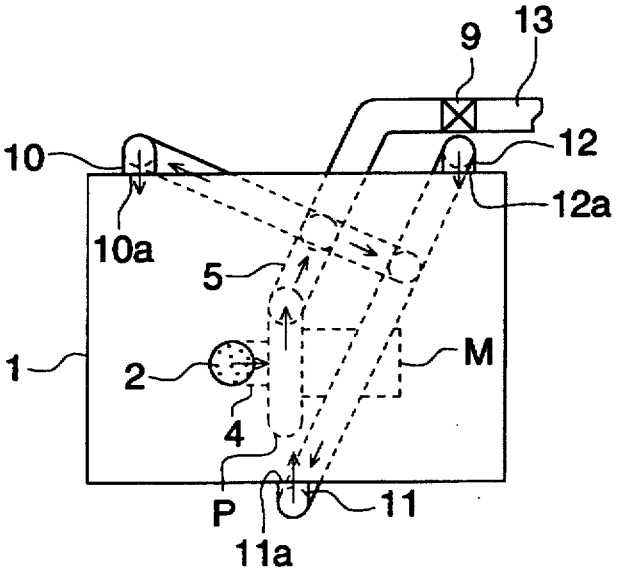
Figure 3:
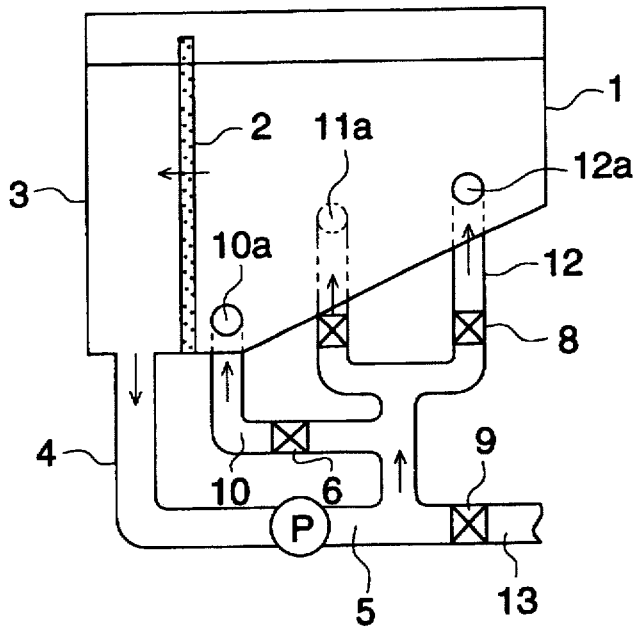
FIG. 3(*a*) is a schematic cross sectional view showing yet another example of a solution preparation apparatus of the present invention.
Figure 3:
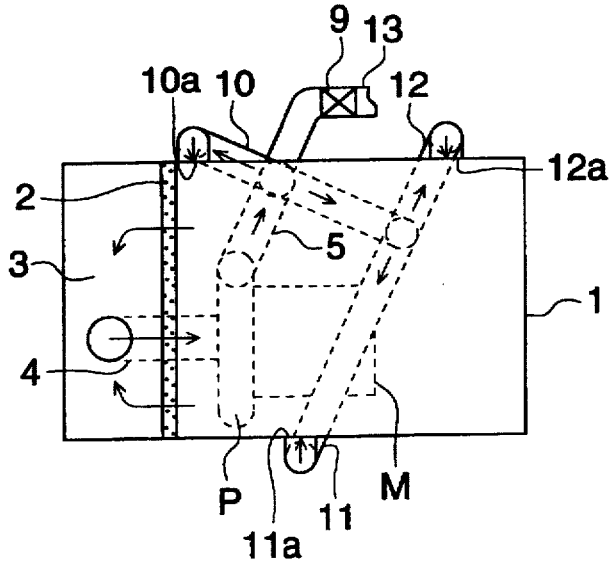
Figure 4:
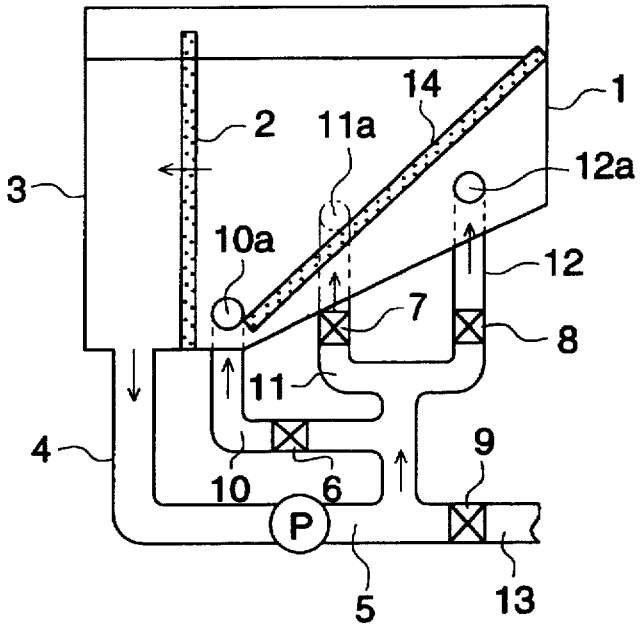
FIG. 4(*a*) is a schematic cross sectional view showing still yet another example of a solution preparation apparatus of the present invention.
Figure 4:
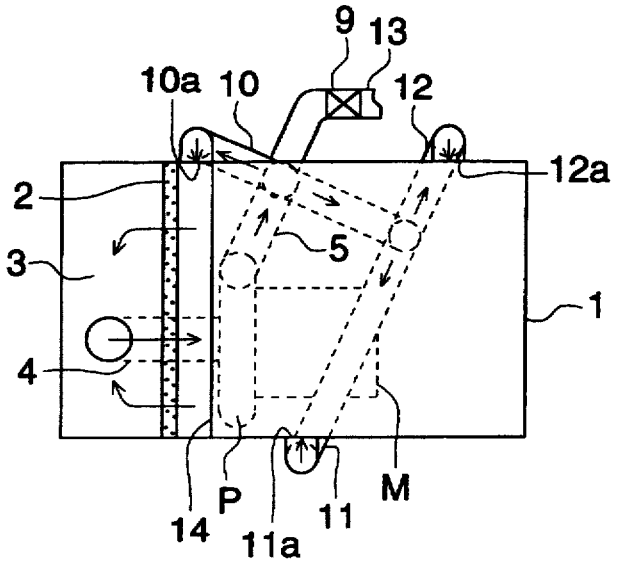
Figure 5:
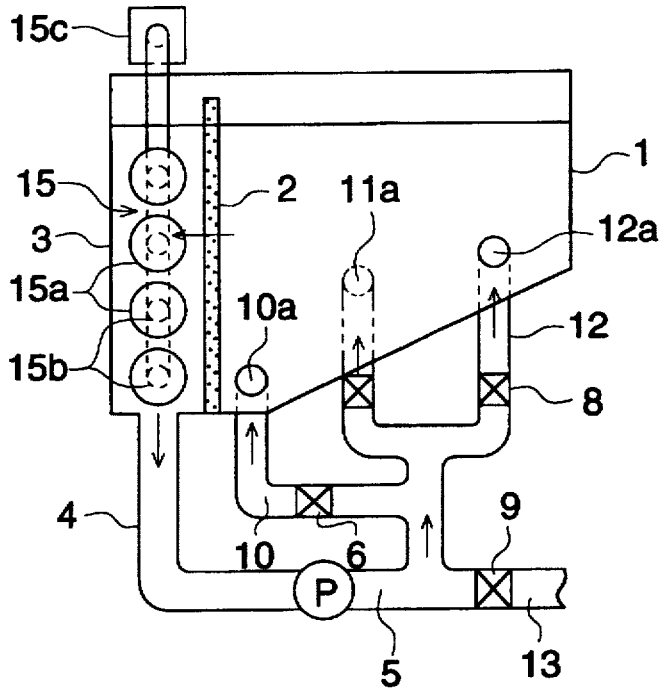
FIG. 5(*a*) is a schematic cross sectional view showing further still yet another example of a solution preparation apparatus of the present invention.
Figure 5:
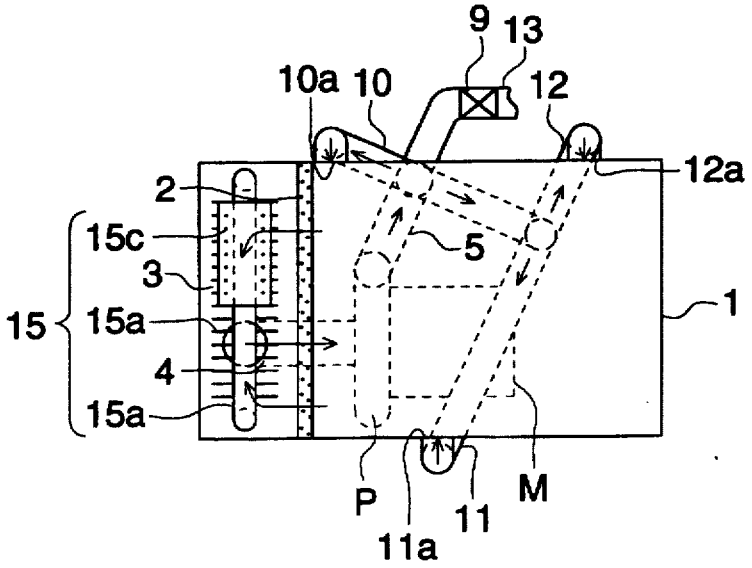
Figure 6:
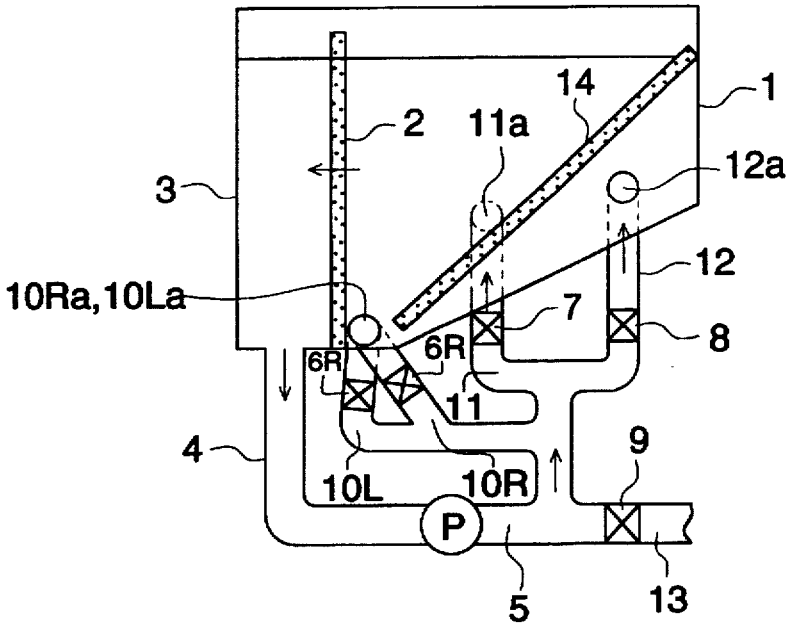
FIG. 6(*a*) is a cross section diagram of an embodiment of the first example.
Figure 6:
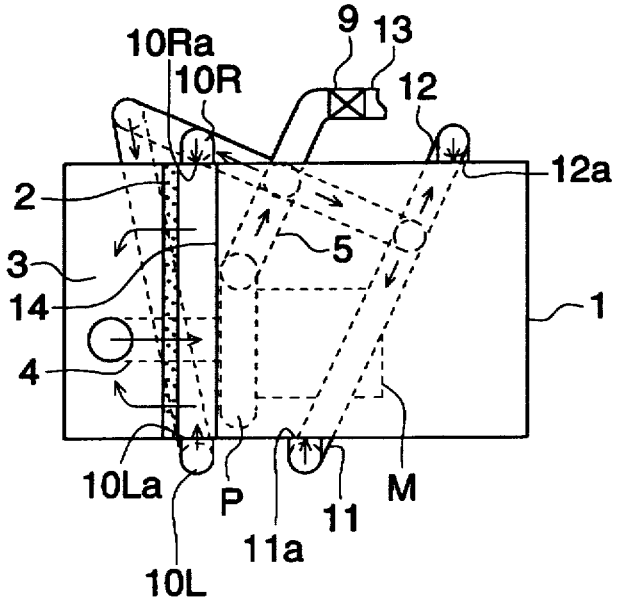

FIG. 2(*a*) is a schematic block cross sectional view showing an example of a solution preparation apparatus of the present invention. FIG. 2(*b*) is a top view thereof. FIG. 3(*a*) is a schematic block cross sectional view showing another example of a solution preparation apparatus of the present invention. FIG. 3(*b*) is a top view of FIG. 3(*a*). FIG. 4(*a*) is a schematic block cross sectional view showing still another example of a solution preparation apparatus of the present invention. FIG. 4(*b*) is a top view thereof. FIG. 5(*a*) is a schematic block cross sectional view showing yet still another example of a solution preparation apparatus of the present invention. FIG. 5(*b*) is a top view thereof. FIG. 6(*a*) is a schematic block cross sectional view showing further yet still another example of a solution preparation apparatus of the present invention. FIG. 6(*b*) is a top view thereof.

In each FIG., numeral 1 represents a dissolution tank which stores a solvent such as water and an organic solvent fed from an upper aperture and then which dissolves solid substance such as a tablet or granule developing agent and a fixing agent supplied thereto. Numeral 2 represents a solid-substance-separation filter which separates the solid substance from the solvent and also is used for removing liquids such as a solvent or a solution. Numeral 3 represented in FIGS. 3(*a*) through 6(*a*) is a solution tank provided adjoining to dissolution tank 1 through solid-substance-separation filter 2, which is used for storing liquid removed from dissolution tank 1 after separating the solid substance. Here, for solid-substance-separation filter 2, a net-type sheet of #30 or less mesh is preferably used. Feeding method for the solvent or supplying method of the solid substance into dissolution tank 1 is not limited to the above-mentioned method. It goes without saying that a supplying path may also be provided separately.

Due to providing solution tank 3, the solution preparation apparatuses in FIGS. 3(*a*) through 6(*a*) can enlarge the filtration area of solid-substance-separation filter 2 and can reduce filtration speed. Accordingly, compared to the solution preparation apparatuses in FIGS. 2(*a*) and 2(*b*), clogging of solid-substance-separation filter 2 can be reduced and life thereof can be extended so that operation cost can further be reduced. In addition, due to solid-substance-separation filter 2, solution wherein undissolved solid substances were separated can be taken up to solution tank 3 from dissolution tank 1. In addition, by lowering the height of solid-substance-separation filter 2 between dissolution tank 1 and solution tank 3 compared to the height of the side wall of both tanks, solution in dissolution tank 1 can overflow into solution tank 3 crossing over solid-substance-separation filter 2 when clogging is excessive in solid-substance-separation filter 2. Accordingly, overflow of solution from both tanks over the side wall can be prevented.

In addition, in FIGS. 3 and others, numeral 4 represents a suction tube at the bottom of dissolution tank 1 or solution tank 3 and removes liquid. P represents a liquid-feeding pump for feeding liquid from suction tube 4 to liquid-feeding tube 5. M represents a motor which drives pump P. Numerals 6, 6R, 6L, 7 and 8 respectively represent returning tubes 10, 10R, 10L, 11 and 12, for circulated liquid, which are communicated to liquid-feeding tube 5. Flow rate regulation valves 10*a*, 10Ra, 10La, 11*a* and 12*a* respectively provided on feeding tube of a solution wherein dissolution has been completed represent jetting ports which jet out circulated liquid into the liquid in dissolution tank 1 approximately horizontally. When a solution is manufactured by dissolving the solid substance in dissolution tank 1, flow rate regulation valve 9 is closed and flow rate regulation valves 6, 6R, 6L, 7 and 8 are opened and adjusted in such a manner that flow rate balance becomes appropriate. By driving pump P, liquid in dissolution tank 1 is caused to circulate. When dissolution is completed, the resulting solution, such as a developing solution and a fixing solution, having a certain density is fed to a developing tank or fixing tank in an automatic processing machine by means of feeding tube 13. The position of feeding tube 13 is not limited to the illustrated example. It may also be provided at the bottom of dissolution tank 1 or solution tank 3 separately for communicating thereto.

As is understood from above, liquid circulated to dissolution tank 1 is circulated after being separated from the solid substance by solid-substance-separation filter 2. Accordingly, the occurrence of damage or function trouble of pump P and flow rate restriction valves 6, 6R, 6L and 7 through 9 due to the solid substance can be prevented. In addition, since jetting ports 10*a*, 10Ra, 10La, 11*a* and 12*a* exit inside dissolution tank 1, a conventional problem in a conventional solution preparation apparatus wherein the circulation liquid jetting tube protrudes inside the dissolution tank so that sediment around the base of the jetting tube occurs takes a considerable time for completely dissolving the solid substance can be overcome. In order to obtain aforesaid effect, the number of jetting port may be one, not necessarily to several, as shown in the illustration. However, due to the following reason, the number of jetting port may be plural.

Jetting ports 10*a* through 12*a* provided on the side walls of dissolution tank 1 in FIGS. 2(*a*) through 5(*a*) will be explained. Jetting ports 10*a* and 12*a* are provided with outlet in a horizontal direction on the same side wall. On the side wall facing aforesaid side wall, jetting port 11*a* is located approximately at the medium between jetting ports 10*a* and 12*a*. In addition, the height of jetting ports 10*a* through 12*a* are different each other. Due to aforesaid structure, liquid inside dissolution tank 1 effects the solid processing substance more effectively and thereby rapidly dissolves the solid substance without creating sediment.

In Examples shown by FIGS. 3(*a*) and 3(*b*) and 5(*a*) and 5(*b*), the bottom of dissolution tank 1 is inclined, and jetting port 10*a* is provided at a position where the solid substance slides along the inclination of the bottom surface and is cumulated. Aforesaid jetting port 10*a* faces inside the dissolution tank. The circulated liquid jeted from aforesaid jetting port 10*a* effectively effects the accumulated solid substance so that aforesaid solid substance is further rapidly dissolved. When the number of aforesaid jetting port is one, it is specifically preferable to take the above-mentioned structure. In such an example, the inclination on the bottom of dissolution tank 1 is not limited to one surface. A mountain-shaped inclination may be adopted to provide two jetting ports at the valley-shaped locations. In such occasions, two suction tubes 4 may be provided at the valley portion as shown in FIGS. 1 or 2(*a*), or solution tank 3 may be provided on a side wall opposite to the side wall wherein the jetting ports have been provided as shown in FIGS. 3(*a*) through 6(*a*).

In the example shown by FIGS. 4(*a*) and 4(*b*), inclined solid-substance-separating filter 14 which causes to slide solid undissolved substance supplied into liquid in dissolution tank 1 along the surface thereof and jetting ports 10*a* through 12*a* on the side surface inside the dissolution tank are caused to jet circulated liquid approximately horizontally and parallel to the surface of inclined filter 14. Among them, jetting port 10*a* jets out the circulated liquid at the bottom of dissolution tank 1 where undissolved substances which slid along the surface of inclined filter 14 are cumulated. Jetting port 11a jets out the circulated liquid at the middle of inclined filter 14 and close to the surface of aforesaid filter 14. Jetting port 12*a* jets out the circulated liquid at the gap between inclined filter 14 and the bottom surface of dissolution tank 1 which is inclined in the same direction as aforesaid inclined filter 14. For this inclined filter 14, a sheet on which there is a filtration holes whose mesh number is #5 or larger is preferably used.

Due to the above-mentioned structure, a part of the circulated liquid jeted out from jetting port 12*a* effects to pass inclined filter so as to separate the solid substances from the surface of aforesaid inclined filter 14. Another part of the circulated liquid effects that minute solid substance which has passed inclined filter 14 is caused to slide along with the inclination of the bottom of dissolution tank 1 and to pass through the gap with inclined filter 14 so as to mix with the solid substance which slid along the surface of inclined filter 14. The circulated liquid jeted out from jetting port 11*a* uniformly effects the entire surface of the solid substance separated from the surface of inclined filter 14. The circulated liquid jeted out from jetting port 10*a* effectively effects undissolved minute solid substance which is cumulated along the inclination of inclined filter 14 and the bottom of dissolution tank 1. Accordingly, dissolution tank 1 as shown by FIGS. 4(*a*) and 4(*b*) much more rapidly and completely dissolves the solid substance compared to dissolution tank 1 as shown by FIGS. 2(*a*) and 2(*b*) naturally and dissolution tank as shown by FIGS. 3(*a*) and 3(*b*).

In an Example as shown by FIGS. 5(*a*) and 5(*b*), temperature-adjusting means 15 provided with heat carrier tubes 15*b* with heat transfer fins 15*a* and thermal medium control unit 15*c* is provided for adjusting the temperature of the circulated liquid from which the solid substance has been separated from dissolution tank 1 to solution tank 3 by solid substance separation filter 2 to temperature capable of dissolving the solid substance easily. Due to temperature-adjusting means 15, the temperature of the circulated liquid in solution tank 1 can be regulated to that capable of dissolving the solid substance easily. Accordingly, the solid substance can be dissolved more rapidly. In addition, since temperature-adjusting means 15 is provided downstream of the solid substance separation filter 2, such as in solution tank 3, there is no possibility that the solid substance conflicts with temperature-adjusting means 15 and adheres so that damage is given or temperature-adjusting means 15 is over-heated for deformation. The type of temperature-adjusting means 15 is not limited to the above-mentioned example. It may also use an electrical heater wherein temperature is controlled by means of a thermistor, or it may heat or cool the circulated liquid by means of a thin heat-transfer tubes. In addition, temperature-adjusting means 15 is not limited to an example wherein it is provided in the solution preparation apparatus as shown by FIGS. 3(*a*) and 3(*b*). Temperature-adjusting means 15 may also be provided in a solution preparation apparatus as shown by FIGS. 4(*a*) and 4(*b*), or 6(*a*) and 6(*b*) or 2(*a*) and 2(*b*).

In an Example as shown by FIGS. 6(*a*) and 6(*b*), in place of jetting port 10*a* in FIGS. 4(*a*) and 4(*b*), jetting ports 10Ra and 10La are provided on each of side surfaces facing each other in dissolution tank 1 in such a manner that the circulated solutionflow interacts. Due to the above-mentioned structure, undissolved-residue solid substance which has been accumulated along the inclination of inclined filter 14 and along the bottom inclination of dissolution tank 1 is effected further effectively compared to an Example as shown by FIGS. 4(*a*) and 4(*b*) so that the solid substance is dissolved more rapidly. As described above, jetting ports 10Ra and 10La may be provided in solution preparation apparatuses as shown by FIGS. 3(*a*) and 3(*b*), and 5(*a*) and 5(*b*) and is not limited to an Example as shown by FIGS. 6(*a*) and 6(*b*).

When dissolution of the solid substance in dissolution tank 1 is completed, any of solution preparation apparatuses in illustrated examples close flow rate restriction valves 6, 6R, 6L, 7 and 8, and as necessary, pump P is driven so that the necessary amount of solution in dissolution tank 1 wherein the density is regulated to a prescribed one is fed to developing tank and fixing tank in the developing apparatus by feeding tube 13. If there remains a solution in a circulation system such as dissolution tank 1 even after aforesaid feeding is completed, flow rate restriction valve 9 is closed. Due to driving of pump P at slower speed compared to a time when the solid substance is being dissolved by appropriately opening flow rate restriction valves 6, 6R, 6L, 7 and 8 as necessary, the solution may be stored while being circulated. The time of completing dissolution of the solid substance may be determined experimentally from the time of solid substance supplying and the start of the circulation of the liquid in dissolution tank 1. However, it is preferable, when measuring the density of the dissolved substance in the circulated solution, to determine that the dissolution is completed when the change of density stops.

An example will be exhibited together with a Comparative example. The Example employs a solution preparation apparatus as shown by FIGS. 2(*a*) and 2(*b*). The Comparative Example employs solution preparation apparatus having the same structure as shown by FIGS. 2(*a*) and 2(*b*) except that the circulation pipe is raised vertically from the bottom of the dissolution tank, the end of the jetting port is curved horizontally and the circulated liquid is caused to jet out horizontally. In both cases, one tablet of a developing agent whose thickness is 10 mm and diameter is 30 mm is supplied into water whose temperature is 30° C. The circulation flow rate of the circulated liquid by means of the pump and the flow rate restriction valves of both cases (Example and Comparative Example) are arranged to be the same. As a result, in the case of Example, it took 8.5 minutes to dissolve the tablet completely. In the case of Comparative Example, it took 10.5 minutes to dissolve the tablet completely.

As Example, by the use of solution preparation apparatuses as shown by FIGS. 2(*a*) and 2(*b*), 3(*a*) and 3(*b*) and 4(*a*) and 4(*b*), 20 tablets of developing agent whose thickness is 10 mm and the diameter is 30 mm are supplied in water at 20° C. The circulation flow rate of the circulated liquid by means of the pump and the flow rate restriction valve of all cases are arranged to be the same. As a result, in the case of Example as shown by FIGS. 2(*a*) and 2(*b*), it took 95 minutes to dissolve all tablets completely. In the case of Example as shown by FIGS. 3(*a*) and 3(*b*), it took 78 minutes to dissolve all tablets completely. In the case of Example as shown by FIGS. 4(*a*) and 4(*b*), it took 50 minutes to dissolve all tablets completely.

As an Example, by the use of a solution preparation apparatus as shown by FIGS. 5(*a*) and 5(*b*), dissolution was conducted in the same manner as in Example as shown by FIGS. 3(*a*) and 3(*b*) except that the temperature of the circulated liquid was regulated to be at 30° C. It took 50 minutes to dissolve all tablets.

As an Example, by the use of a solution preparation apparatus as shown by FIGS. 6(*a*) and 6(*b*), dissolution was conducted in the same manner as in Example as shown by FIGS. 3(*a*) and 3(*b*) except that the jetting amount of the circulated liquid from jetting ports 10Ra and 10La was arranged to be slightly over ½ than that by FIG. 3(*a*) and 3(*b*). It took 30 minutes to dissolve all tablets.

Figure 7:
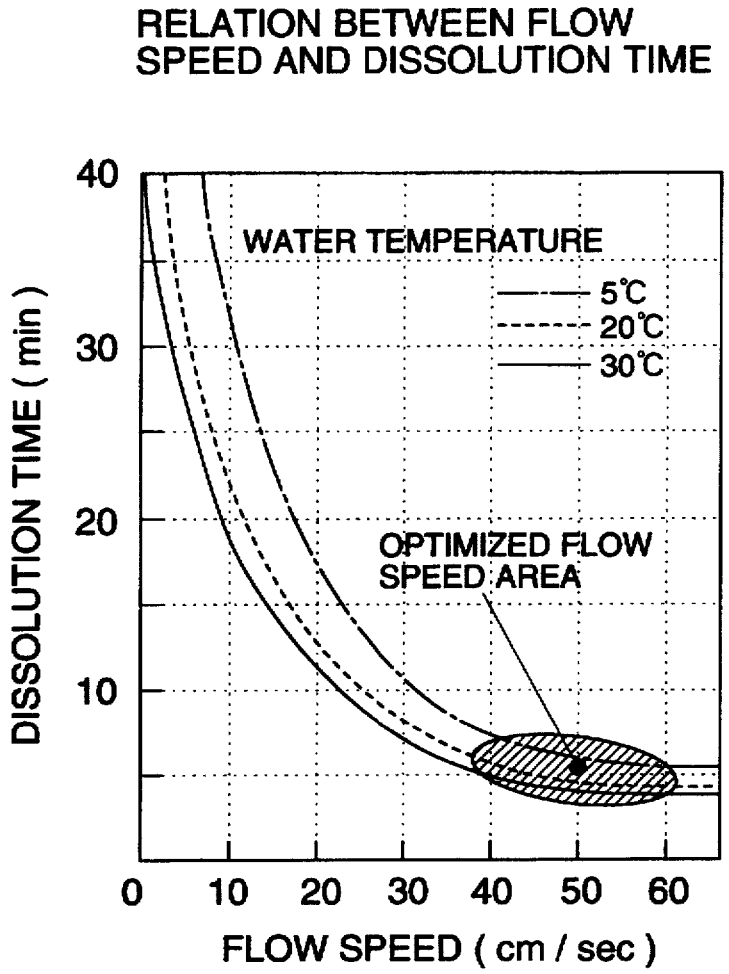
FIG. 7 is a drawing showing the relationship of solution temperature, flow rate and dissolution time.

In above, dissolution time necessary for dissolving the processing agents completely was compared depending upon the constitution of the preparation apparatus. Next, influence of solution temperature and flow rate on the dissolution time will be explained referring to FIG. 7.

A jetting port corresponding to jetting port 10*a* in FIG. 2(*a*) was provided in the vicinity of bottom portion of a small tank for testing so that jet flow in the horizontal direction was caused to occur. By changing the flow rate of this jet flow and solution temperature inside the tank, dissolution time necessary for completely dissolving one developing agent tablet whose thickness was 10 mm and diameter was 30 mm supplied from the top of the container was measured. As is understood from the relationship between the flow rate and the dissolution time in FIG. 7, the higher the flow rate of the jet flow is, the shorter the dissolution becomes. However, when the flow rate becomes higher than 40 cm/sec, the ratio in which the dissolution time is shortened becomes smaller to be saturated. Accordingly, it is preferable to operate under the range of the flow rate of 40 cm/sec. to 60 cm/sec compared with increasing the load of the electric motor higher than 60 cm/sec.

With regard to the solution temperature, the higher, the shorter the dissolution time is. Accordingly, it is preferable to provide a temperature-regulating means as shown in FIGS. 5(*a*) and 5(*b*).

In order to make compact the solution temperature, it is considered to lessen the number of pump used as a circulation means. For this purpose, one pump is used in FIGS. 2(*a*) through 6(*a*). In aforesaid FIGS., the circulating solution is branched due to several branched pipe so thataforesaid circulating solution is jetted from several jetting port. Flow rate of jetting flow from each jetting port can be regulated by means of a flow rate control valve. In this occasion, it is preferable to increase the speed of the flow rate highestly at a portion where solid substance is concentrated. Practically, in an apparatus as shown in FIG. 3(*a*), by increasing flow rate of the jetting flow from jetting port 10*a* in the vicinity of the bottom of the tank highestly to be arranged at 40 cm/sec. to 60 cm/sec., the solid. processing agent can be dissolved most effectively, and the apparatus can be arranged compact.

As described in detail above, the solution preparation apparatus of the present invention is a circulation type wherein aforesaid apparatus is compact and the solution is less likely to be oxidized and deteriorated. In addition, the solution preparation apparatus of the present invention provides noticeable effects that the solid substance can be dissolved in a short time.

Figure 8:
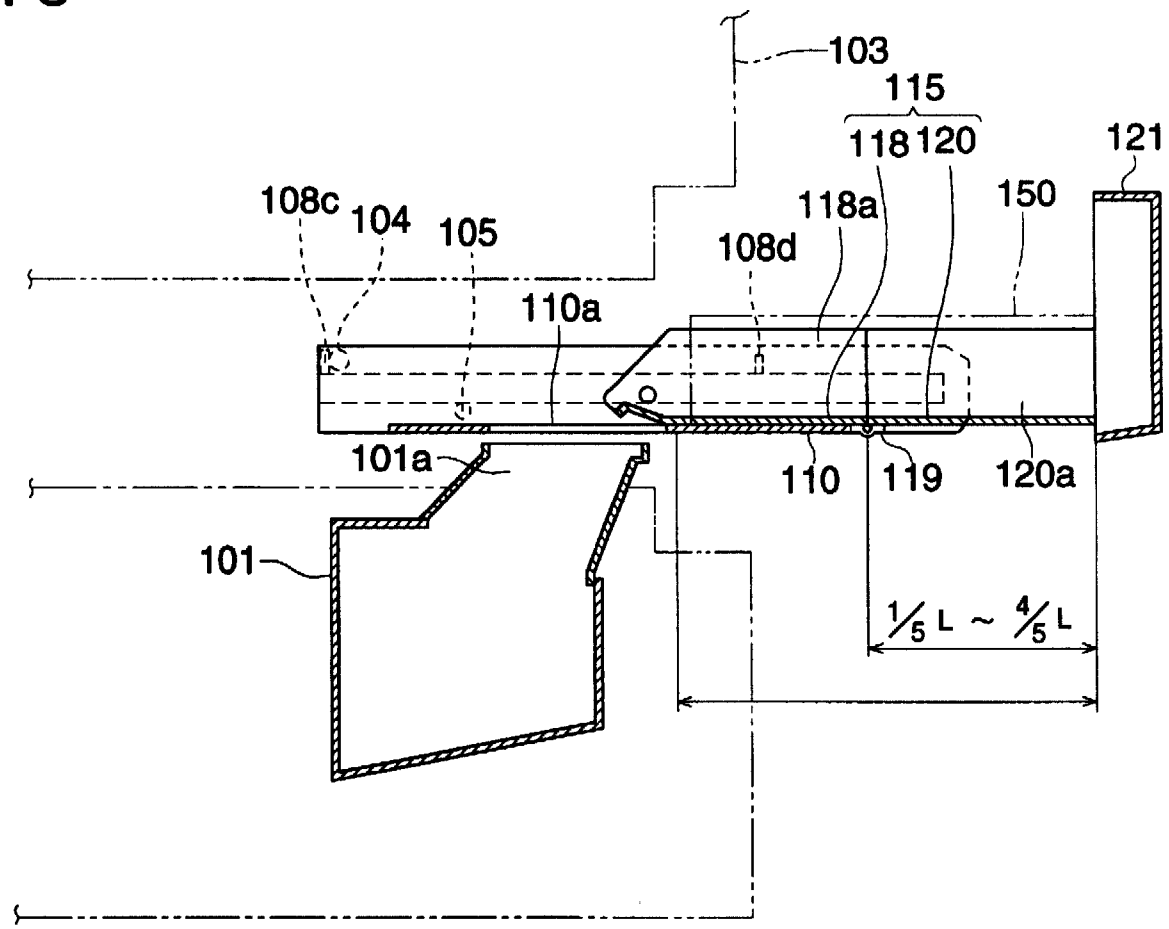
FIG. 8 is a cross sectional view of the first embodiment of the supplying device.
Figure 9:
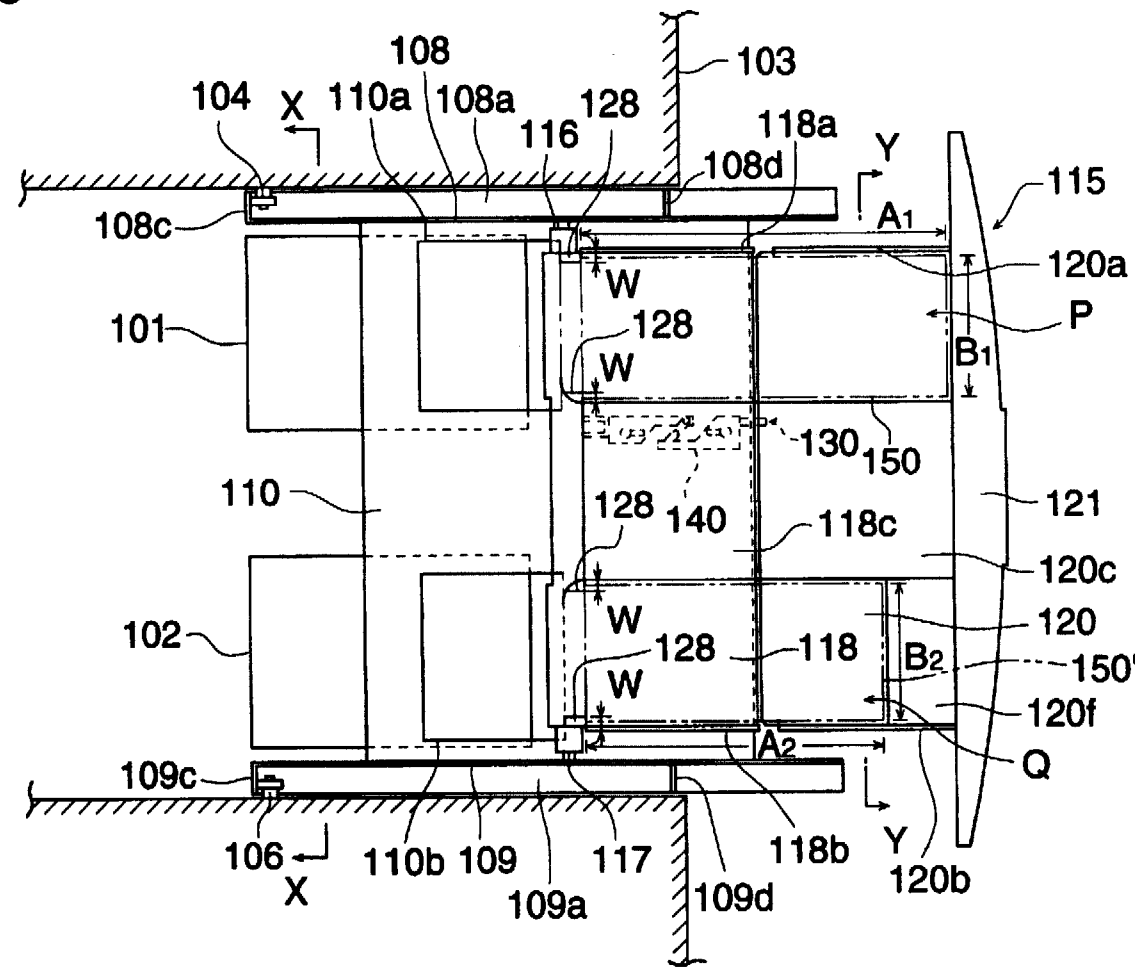
FIG. 9 is a plane view in FIG. 8.
Figure 10:
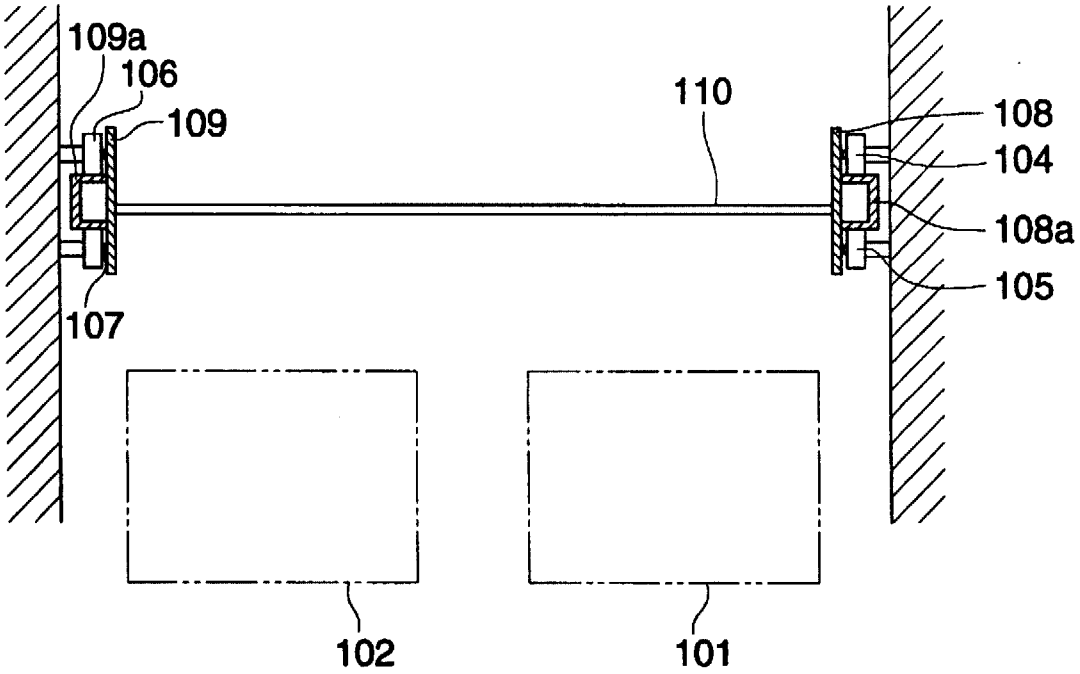
FIG. 10 is a cross sectional view of a cutting line X—X in FIG. 9.
Figure 11:
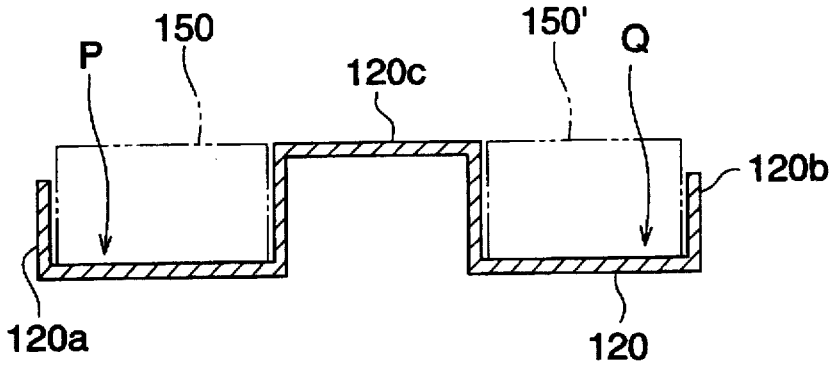
FIG. 11 is a cross sectional view of a cutting line in FIG. 9.

Next, referring to drawings, embodiments of the present invention will be explained. FIG. 8 represents a cross sectional block diagram of an embodiment of the first Example of the present invention. FIG. 9 represents a top view of FIG. 8. FIG. 10 is a cross sectional view at a line X—X of FIG. 9. FIG. 11 is a cross sectional view at a crossing line Y—Y of FIG. 9.

In aforesaid figures, numerals 101 and 102 are provided on apparatus main body 103, and are open at the top portion.

On one of side wall in apparatus main body 103 above tank 101, guide rollers 104 and 105 which serves as a guide at different horizontal and vertical position are provided.

In addition, on the other side wall in apparatus main body 103 above tank 102, guide rollers 106 and 107 which serves as a guide at different horizontal and vertical position are provided.

Numeral 108 represents the first slider having rail portion 108*a* sandwiched by guide rollers 104 and 105 and movable horizontally. Numeral 109 represents the second slider having rail portion 109*a* sandwiched by guide rollers 106 and 107 and movable horizontally.

Incidentally, regarding rail portion 108*a*, guide roller 104 is brought into contact with, forming stoppers 108*c* and 108*d* which prohibit movement of first slider 108 over aforesaid stoppers. In the same manner, on rail portion 109*a*, guide roller 106 is brought into contact with, forming stoppers 109*c* and 109*d* which prohibit movement of second slider 109 over aforesaid stoppers.

Numeral 110 is a plate connecting first and second sliders 8 and 9. Therefore, first and second sliders 108 and 109 and plate 110 are integral. Guide rollers 104 and 106 can move horizontally within a range that aforesaid guide rollers 104 and 106 are brought into contact with stoppers 108*c* and 109*c* and stoppers 108*d* and 109*d*. Incidentally, in the present embodiment of the Example, when guide rollers 104 and 106 are brought into contact with stoppers 108*c* and 109*c*, this status is referred to as "drawn" status (a status as shown in FIGS. 8 and 9), and when guide rollers 104 and 106 are brought into contact with stoppers 108*d* and 109*d*, this status is referred to as "housed" status.

During "drawn" status, on plate 110, holes 110*a* and 110*b* which face open surface 101*a* and 102*a* respectively in tanks 101 and 102 are provided.

Numeral 115 represents a table capable of rotating upward using pins 116 and 117 from first and second sliders 108 and 109. Aforesaid table 115 is composed of first table 118 and second table 120.

First table 118 can be brought into contact with plate 110. Namely, first table 118 is prohibited to rotate downward by plate 110, but it only can be rotated upward in relationship to first and second sliders 108 and 109.

Second table 120 is mounted on first table 118 using hinge 119 provided on first table 18 along a side of first table 18 opposite to the side of tanks 101 and 102. Second table can be rotated downward from first table 118.

Incidentally, in the embodiment of the present Example, provided that the total length of first table 118 and second table 120 be "L", the length of second table 120 is set to be (1/5)L–(4/5)L.

On a side of rotating end of second table 120, cover 121 is mounted.

On the side of first and second tables 118 and 120, vertical wall 118*a*, 118*b*, 120*a* and 120*b* are formed. On the central portion of first and second tables 118 and 120, raised partitioning sections 118*c* and 120*c* which are raised partitioning portion (see FIG. 11).

Figure 12:
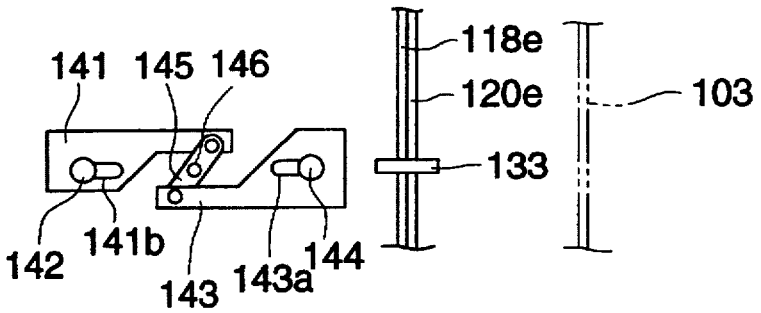
FIGS. 12(*a*) and 12(*b*) are a schematic view of the lock mechanism and the lock releasing mechanism shown in FIG. 9, and FIG. 12(*a*) shows a top view, and FIG. 12(*b*) shows a side view.
Figure 12:
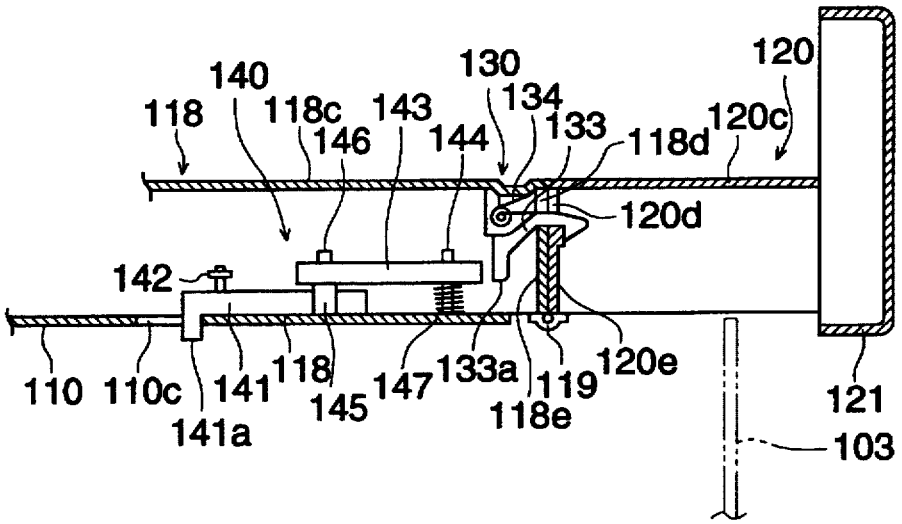

As shown in FIG. 12, on second table 20, and between raised portion 120*c* on the cover 121 side of second table 120 and vertical wall 120*b*, raised spacer portion 120*f* which is a raised portions upward is formed.

On a convex portion formed by cover 121, vertical walls 120*a* and 118*a* and raised portions 118*c* and 120*c*, first package setting section P is formed. Similarly, on a convex portion formed by raised spacer portion 120*f*, vertical walls 120*b* and 118*b* and raised portions 118*c* and 120*c*, second packaging setting section Q is formed.

In the embodiment of the present Example, provided that the transversal size of the first package setting section A is A1, the lateral size thereof is B1, the transversal size of the second package setting section B is A2 and the lateral size thereof is B2, the following inequalities were made:

A1>A2

B1<B2 by which erroneous setting was intended to be prevented.

In addition, on package setting sections P and Q, ribs 28 having a width (W) of about 1–10 mm are respectively mounted to limit movement of the package, as described later.

Inside raised portion 118*c* of first table 118, lock mechanism 130 which prohibits rotation of second table 120 is provided. On plate 110 facing raised portion 118*c* of first table 118, lock releasing mechanism 140 which releases locking state of aforesaid lock mechanism 130 is provided.

Figure 13:
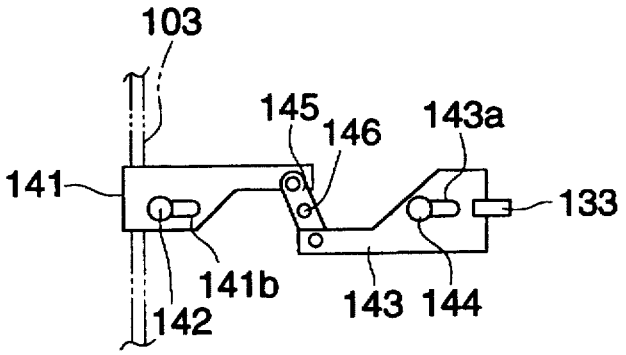
FIGS. 13(*a*) and 13(*b*) are drawings explaining operation in FIG. 12.
Figure 13:
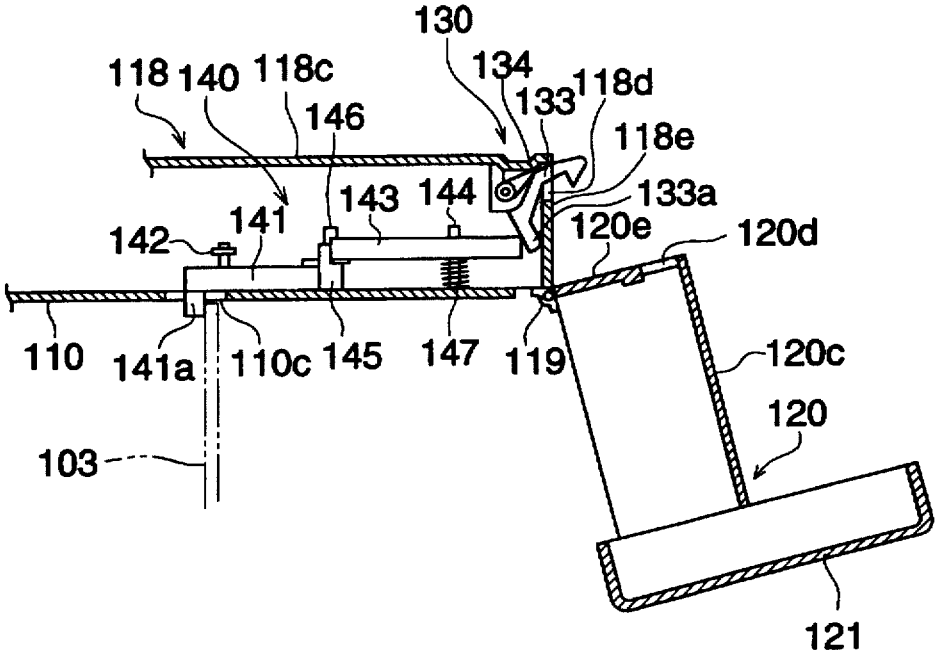
Figure 16:
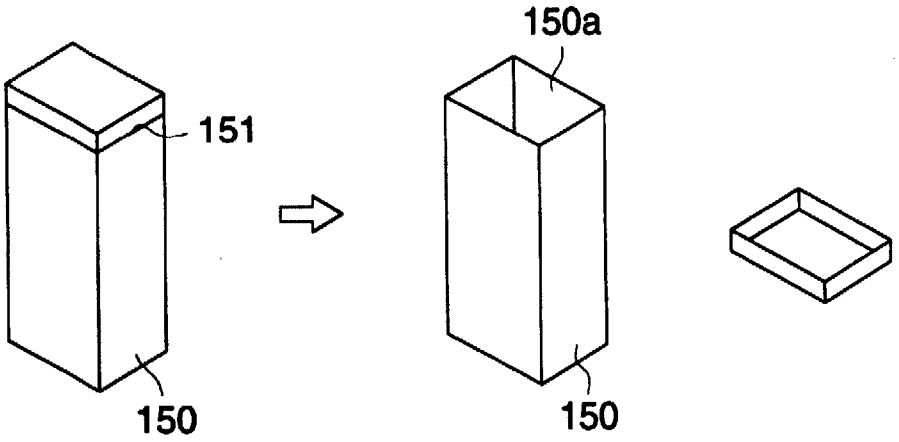
FIG. 16 shows an explanation drawing of the package.

FIGS. 12 is a block diagrams of lock mechanism 130 and lock releasing mechanism 140 as shown in FIG. 9. FIG. 12(*a*) shows a top block diagram, FIG. 12(*b*) shows a side block diagram and FIG. 13 shows a drawing explaining operation in FIG. 12. FIG. 16(*a*) shows a top block diagram and FIG. 13(*b*) shows a side block diagram.

First, lock mechanism 130 provided on raised portion 18*c* of the right of first table 118 will be explained. On facing walls 18*e* and 20*e* on hollow raised portion 118*c* of first table 118 and raised portion 120*c* of second table 120, facing holes 118*d* and 120*d* are opened.

Inside raised portion 118*c*, lock lever 133 which penetrates holes 118*d* and 120*d* and which can then engage with the inside of facing wall 120 in raised portion 120*c* is provided rotatably.

Due to spring 34 wherein the center portion is wound on the rotation shaft of lock lever 133, one end portion is engaged with lock lever 133 and the other end is engaged with the internal wall of protruded portion 118*c*, lock lever 133 is biased to a direction in which aforesaid lock lever is engaged inside surface of facing wall 120*d* of protruded portion 120*c*, prohibiting rotation of second table 120 downward (locking status).

Next, lock releasing mechanism 140 provided on plate 110 facing raised portion 118*a* on first plate will be explained.

Figure 15:
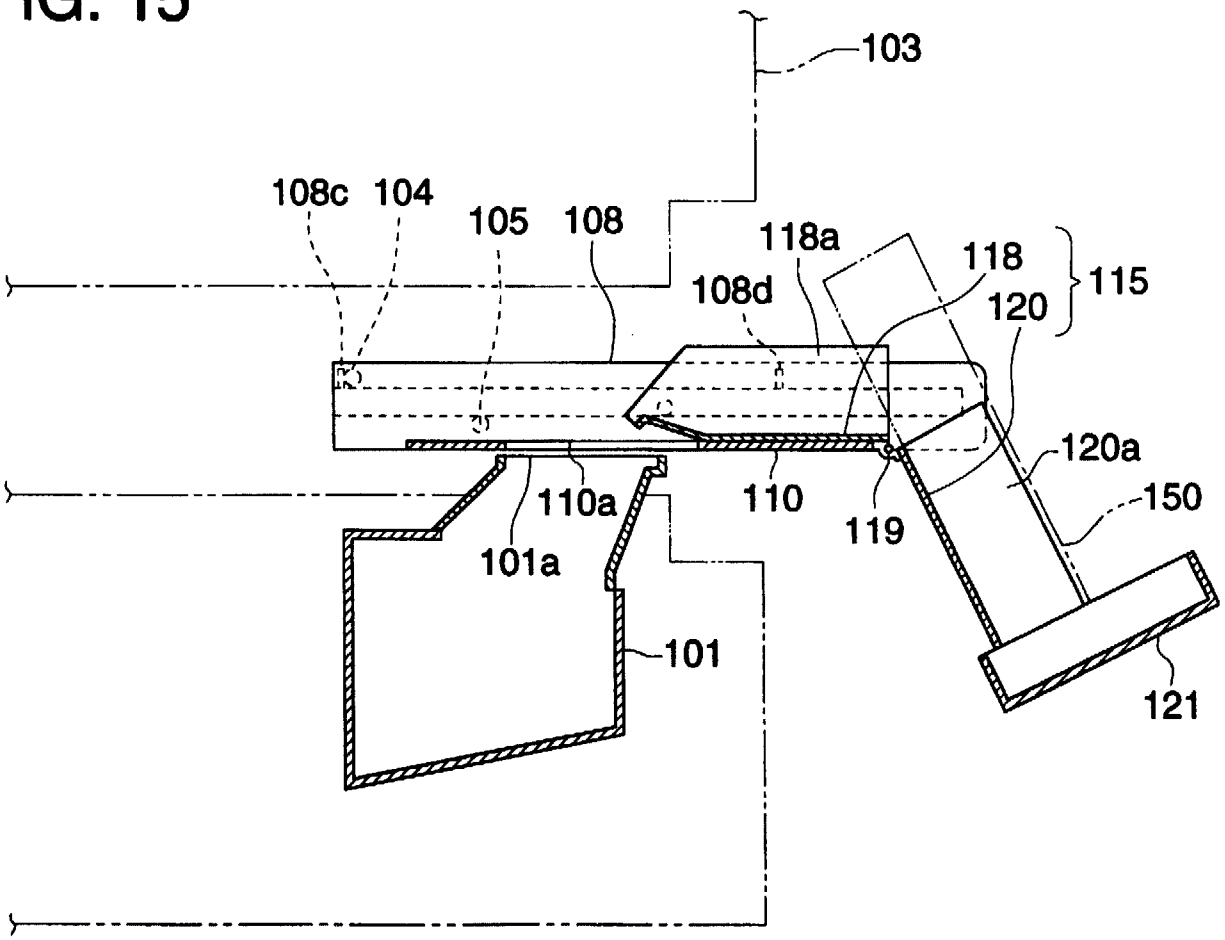
FIG. 15 shows a schematic view when the package is set in FIG. 8.

In FIG. 15, numeral 141 represents the first link in which elongated hole 141*b* wherein pin 142 loosely fits is provided. Numeral 143 represents the second link in which elongated hole 143*a* wherein pin 144 standing vertically on plate 110 loosely fits is provided.

Numeral 145 represents the third link which is mounted rotatably on plate 110 using pin 146 vertically standing on plate 110 wherein one of rotation end is mounted on first link 141 rotatably and the other rotation end is mounted on second link 143 rotatably.

Due to a torsion spring (not illustrated) wherein one end is engaged with plate 110 and the other end is engaged with third link 145, first link 141 and second link 143 are biased in directions wherein each links approach each other. Incidentally, the spring which biases first link 141 and second link 143 in such a manner that both approach each other may be a spring wherein one end is engaged to first link 141 and the other end is engaged in second link 143.

Second link 143 is wound on pin 144 and floats from first table 118 due to spring 134 which presses second link 143 on the head of pin 144.

On first link 141, raised portion 141*a* which is protruded to outside through hole 110*c* which extends in the advancement direction of table 115 on plate 110.

Accordingly, when table 15 is drawn to the drawn position, as shown by FIG. 13, raised portion 141*a* on first link 141 contacts the inner wall of apparatus 3 so that the movement of first link 141 is prohibited and that first link 41 retrieves relatively with table 15.

Following this, second link 143 advances to press arm portion 133*a* of lock lever 133 against the force of spring 134. As shown in FIG. 13, pressed lock lever 133 rotates counter-clockwise. Engagement between lock lever 133 and inner wall of facing wall 120*d* of raised portion 120*c* is released (lock-released status) so that second table becomes able to rotate downward.

Next, the overall function of the above-mentioned constitution will be explained. (1) Housed status (see FIG. 14)

Table 15 is located above tanks 101 and 102. Namely, it is a housed status wherein stoppers 108*d* and 109*d* on sliders 108 and 109 are in contact with guide rollers 104 and 106.

Here, table 15 is drawn in a direction that the table is removed from tanks 101 and 102.

When first slider 108 and second slider 109 come to prescribed positions respectively during movement of table 15, namely, as shown in FIG. 13, when stoppers 108*c* and 109*c* of first slider 108 and second slider 109 reach positions where they contact guide rollers 104 and 106, lock lever 133 rotates so that locking in lock mechanism 130 is released. Accordingly, second table 120 comes to be rotatable. (2) Setting of the package (see FIG. 15)

Second table 120 is caused to rotate downward so that a package is set to first and second package setting portions A and B of second table 120.

As shown in FIG. 16, package 150 of the embodiment of the present Example is a rigid rectangular solid made of paper or resin wherein a light-sensitive material processing agent is housed therein. By peeling tape 151, one end of the package is opened for forming open face 150*a*.

The light-sensitive material housed in package 150 includes a developing agent, a fixing agent and a bleaching agent. In the embodiment of the present Example, package 150 housing aforesaid developing agents is set into package setting portion and package 150' housing the fixing agents is set into packaging setting portion B. Hereinafter, with regard to package 150', portions identical to those in package 50 are odentified with ['].

The external dimensions of package 150 and package 150' are respectively approximately the same as the dimensions of package setting portion P and package setting portion Q to prevent erroneous setting.

Packages 150 and 150' are set respectively into each package setting portions A and B wherein open ends 150*a* and 150*a'* face upward. By peeling off tapes 150*a* and 150*a'* of each package 150 and 150', packages 150 and 150' are opened. When the opening operation is finished, second table 120 is caused to rotate upward.

When second table 120 becomes approximately horizontal, facing wall 118*e* of raised portion 118*c* of first table 115 and facing wall 120*e* of raised portion 120*c* of second table 120 are brought into contact each other so that first and second tables 118 and 120 integrally rotate upward.

Figure 18:
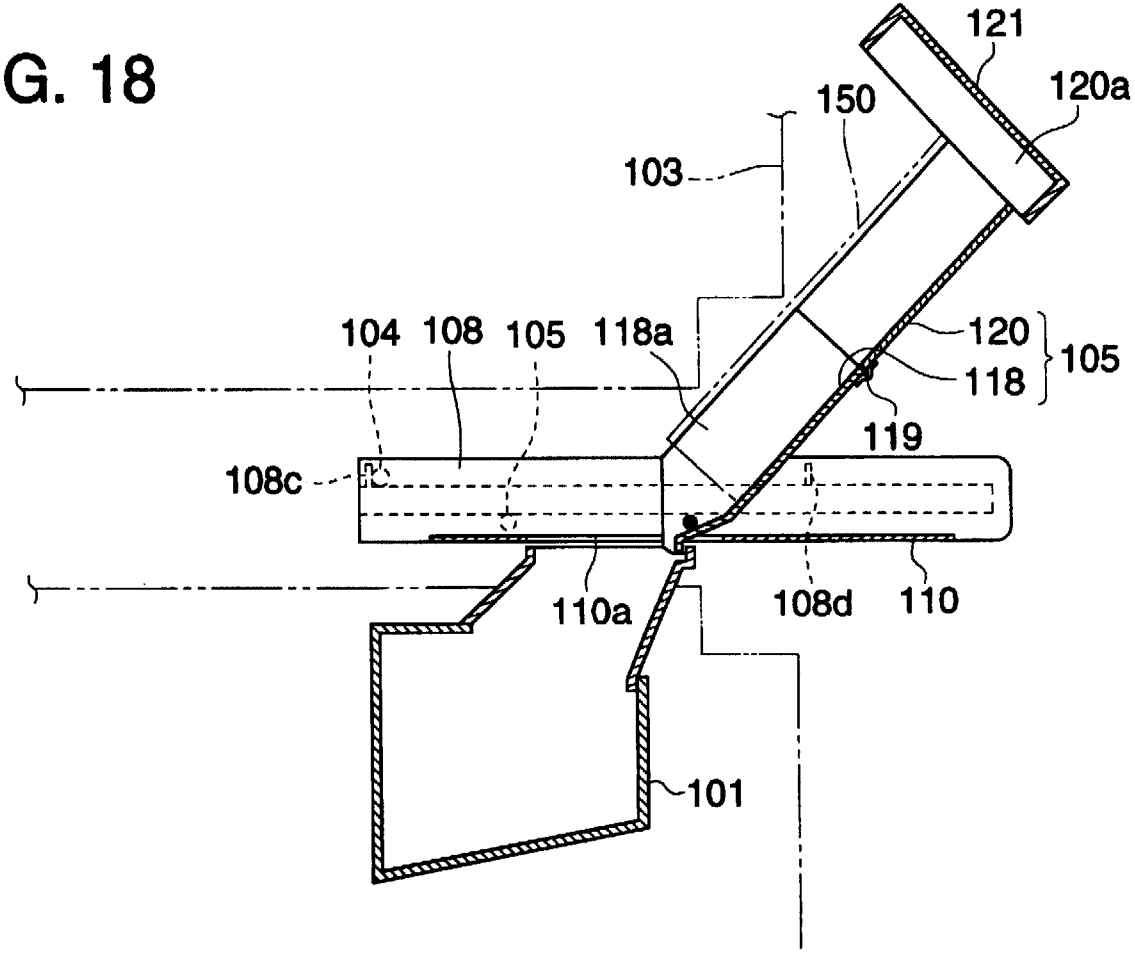
FIG. 18 shows a schematic view when the light-sensitive material processing agents are supplied in FIG. 8.

When first and second tables 118 and 120, namely table 115 rotate slightly upward from approximately horizontally status, contact status between arm portion 133*a* of lock lever 133 of locking mechanism 130 provided on table 115 side and second link 143 of locking-canceling mechanism 140 provided on plate side 110 is released. Locking lever 133 rotates clockwise due to biased force of spring 134, and engages with the inner surface of facing wall 120*e* of raised portion 120*c* of second table 120. Locking mechanism 130 becomes locked status again. (3) Supplying of processing agent (see FIG. 18)

Further, if table 15 is totally rotated upward, only light-sensitive material processing agents are supplied to tanks 101 and 102 through holes 10*a* and 10*b* since movement of the package 150 and 150' is prohibited by rib 128.

When supplying is completed, table 115 is returned to horizontal status.

Figure 17:
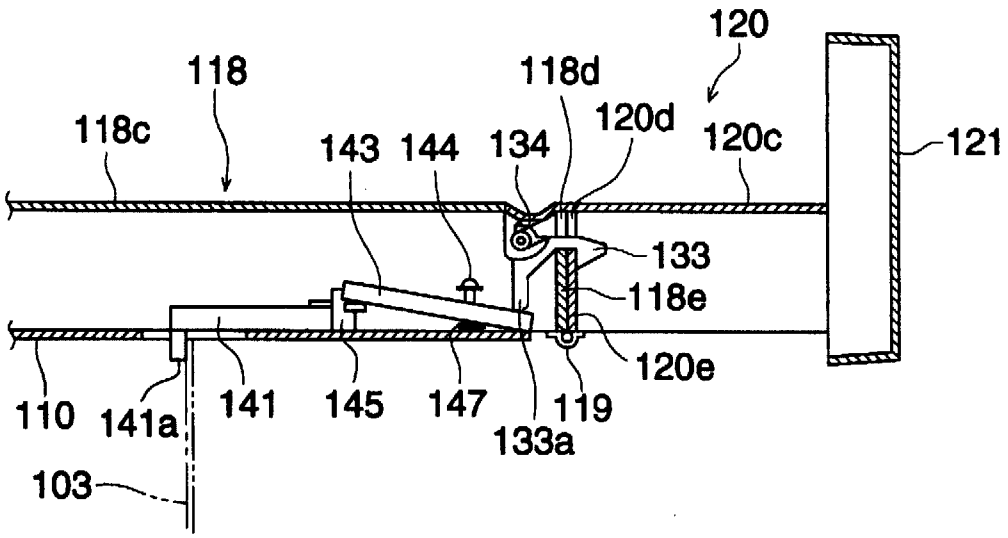
FIG. 17 is a view showing the operation of the lock mechanism.

In this occasion, as shown in FIG. 17, arm portion 133*a* of lock lever 133 rides on second link 143.

Figure 14:
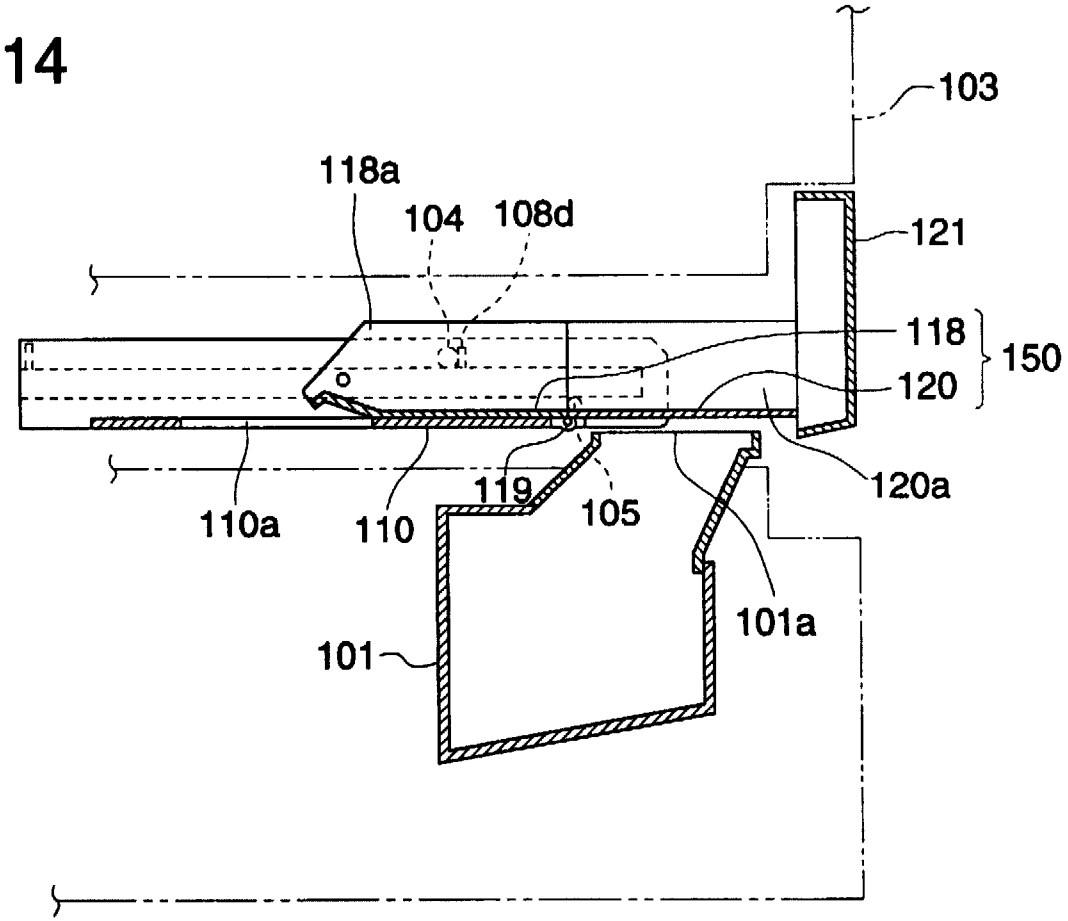
FIG. 14 shows a schematic view at a housing position in FIG. 8.

Finally, by pressing table 115 toward apparatus main body side 103, table 115 returns to housed position as shown in FIG. 14.

In this occasion, the contact between first link 141 and inner wall of apparatus main body is released so that locking releasing mechanism 140 returns to a status as shown in FIG. 12.

Owing to the above-mentioned structure, second table 120 rotates downward compared to first table 118. By setting packages 150 and 150' on package setting portions P and Q of second table 20 while open ends 150*a* and 150*a'* face upward, opening movement becomes stable and there is no fear that the light-sensitive material processing agents may not splash.

In addition, lock releasing mechanism 140 does not release lock mechanism 130, unless first and second sliders 108 and 109 do not move until prescribed position. Accordingly, the lock mechanism is not released and packages 150 and 150' cannot be set. Therefore, erroneous setting operation can be prevented.

In addition, by setting package setting portion A and B corresponding to each of packages 150 and 150', erroneous setting of packages 150 and 150' can be prevented.

By mounting rib 128, on first table 118, which prohibits movement of packages 150 and 150' to the direction of tanks 101 and 102, table 115 is caused to rotate upward. Therefore, when light-sensitive material processing agents inside packages 150 and 150' are supplied in the tank, supplying of packages 150 and 150' into tanks 101 and 102 can be prevented.

Incidentally, the present invention is not limited to the embodiments of the above-mentioned Example.

Figure 19:
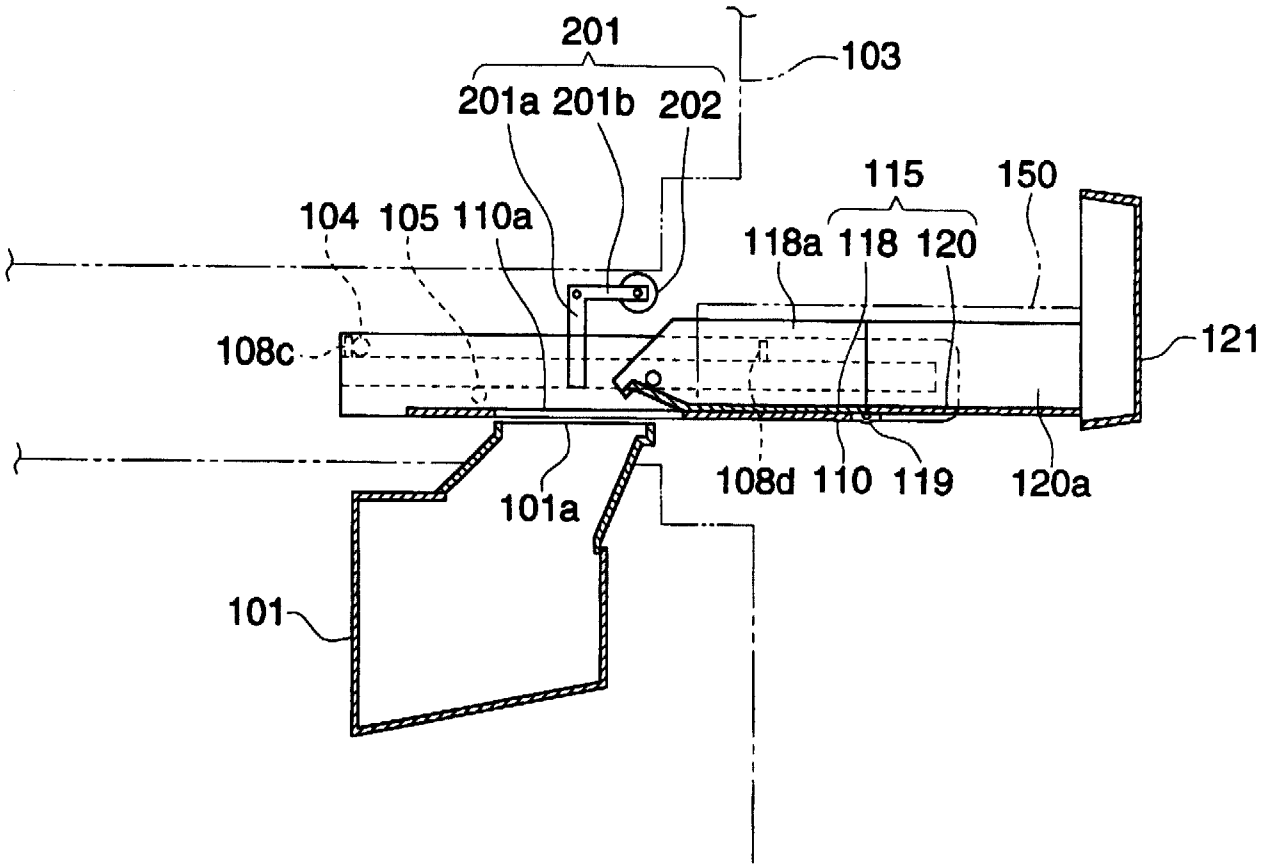
FIG. 19 is a drawing explaining an embodiment of another example of the present invention.

For example, as shown in FIG. 19, a crushing mechanism of the packages may be provided. In FIG. 19, numeral 101 is an approximately L-shaped lever, which is provided rotatably on apparatus main body 103 side and composed of first arm 101*a* capable of contacting edge of table 115 and second arm 101*b* wherein crushing roller 102 which can press packages 150 and 150' remained on table 115.

Lever 101 is biased in such a manner that first arm 101*a* interferes movement range of table 115 due to a biasing means (not illustrated).

Due to providing the above-mentioned lever 101, when table 115 is housed after supplying the light-sensitive material processing agents, lever 101 rotates opposing to the biasing force by a biasing means (not illustrated) due to table 115 so that crushing roller 102 crushes packages 150 and 150' remained on table 115.

When the light-sensitive material processing agents are supplied the next time, at a time when table 115 is drawn, crushed packages 150 and 150' are removed.

As described above, by providing a crushing mechanism, after supplying the light-sensitive material processing agents, packages 150 and 150' are crushed compactly. Therefore, storage space can be saved, In addition, it is not necessary to convey the package outside the room. Therefore, post processing becomes easier.

Incidentally, as a crushing member, in addition to crushing roller 102, a shoe-type may be used if it has less abrasive member.

In addition, in the above-mentioned embodiment of the present Example, the kind of the light-sensitive material processing agents were two. However, the present invention may employ one-kind type or three or more kinds type.

In the case of three or more kinds, it is preferable to set the dimension of package setting portion in such a manner that there shall be no erroneous setting.

Due to a structure in which the light-sensitive material processing agent supplying apparatus of the present invention is, as described above, composed of a rigid package and open surface capable of being opened in which a light-sensitive material processing agent is housed, a tank on which the above-mentioned opening is opened and through which the light-sensitive material processing agent inside the above-mentioned package is supplied, a guide which is provided above the open surface of aforesaid tank and which extends in approximately horizontal direction, a slider which engages with aforesaid guide oscillably, the first table which is provided on aforesaid slider and which is capable of rotating upward against the above-mentioned slider and the second table provided rotatably along a side which is opposite to the side of the tank side on aforesaid first table, wherein the above-mentioned second table is engaged with the above-mentioned package and provided with a table on which a package setting portion prohibiting movement to the direction other than the above-mentioned tank on the second table plane is formed, a lock mechanism which prohibits rotation of the above-mentioned second table against the above-mentioned first table and a lock canceling mechanism which cancels the above-mentioned lock mechanism when the above-mentioned table comes to a prescribed position of the above-mentioned guide, the second table rotates downward compared to the first table and opening operation of the package becomes stable due to a structure that aforesaid package is set on the package setting portion on the second table in such a manner that the opened portion faces upward so that there is no concern that the light-sensitive material processing agents may not splash.

In addition, the lock releasing mechanism does not releases the lock mechanism, unless the slider moves to a prescribed position. Accordingly, it cannot set the package so that erroneous operation can be prevented.

Here, the above-mentioned package is composed of plural kinds having different size each other, and due to providing the package setting portion corresponding to each package on the above-mentioned table, erroneous setting of the package can be prevented.

In addition, by mounting a member which prohibits movement of the above-mentioned package to the above-mentioned tank, the table can be rotated upward, and when the light-sensitive material processing agents inside the package are supplied to the tank, supplying of the package into the tank can be prevented.

In addition, due to providing a mechanism to crush the package after the light-sensitive material processing agents are supplied and a mechanism to operate aforesaid crushing mechanism in synchronous with the movement of the above-mentioned slider to the above-mentioned tank, the package after supplying the light-sensitive material processing agents can be crushed to set the apparatus more compact. Storage space can be saved, and conveyance operation of the package to out of the room can be omitted. Thus, post treatment of the package becomes easy.

What is claimed is:

1. An apparatus for dissolving solid processing agent for photographic light-sensitive material comprising:

a dissolving tank in which a solution is stored, said dissolving tank provided with a supplying port through which said solid processing agent is supplied into said dissolving tank, a collecting section provided in said dissolving tank, for collecting the supplied solid processing agent;

a filter in said dissolving tank for guiding the supplied solid processing agent to said collecting section;

said dissolving tank having a suction port and a first jetting port;

a circulator for sucking said solution through said suction port from said dissolving tank and for discharging the solution through said first jetting port into said dissolving tank, wherein said first jetting port is at a position corresponding to said collecting section whereby said solution is jetted toward said solid processing agent collected by said collecting section.

2. An apparatus for dissolving solid processing agent for photographic light-sensitive material comprising:

a dissolving tank in which a solution is stored, said dissolving tank provided with a supplying port through which said solid processing agent is supplied into said dissolving tanks, said dissolving tank having a second jetting port, a jetting speed from said first jetting port being faster than that from said second jetting port;

a collecting section provided in said dissolving tank, for collecting the supplied solid processing agent;

a guide member in said dissolving tank for guiding the supplied solid processing agent to said collecting section;

said dissolving tank having a suction port and a first jetting port;

a circulator for sucking said solution through said suction port from said dissolving tank and for discharging the solution through said first jetting port into said dissolving tank, wherein said first jetting port is at a position corresponding to said collecting section whereby said solution is jetted toward said solid processing agent collected by said collecting section.

3. The apparatus of claim 2 wherein the circulating means is a single pump.

4. An apparatus for dissolving solid processing agent for photographic light-sensitive material comprising:

a dissolving tank in which a solution is stored, said dissolving tank provided with a supplying port through which said solid processing agent is supplied into said dissolving tank, said dissolving tank having a second jetting port, a jetting speed from said first jetting port being faster than that from said second jetting port;

a collecting section provided in said dissolving tank, for collecting the supplied solid processing agent;

a guide member in said dissolving tank for guiding the supplied solid processing agent to said collecting section;

said dissolving tank having a suction port and a first jetting port;

a circulator for sucking said solution through said suction port from said dissolving tank and for discharging the solution through said first jetting port into said dissolving tank, wherein said first jetting port is at a position corresponding to said collecting section whereby said solution is jetted toward said solid processing agent collected by said collecting section;

a control for controlling a temperature of said solution; and a filter preventing said solid processing agent from adhering to said control.

5. An apparatus for dissolving solid processing agent for photographic light-sensitive material comprising a dissolving tank in which a solution is stored, said dissolving tank provided with a supplying port through which said solid processing agent is supplied into said dissolving tanks, said dissolving tank having a second jetting port, a jetting speed from said first jetting port being faster than that from said second jetting port;

a collecting section provided in said dissolving tank, for collecting the supplied solid processing agent;

a guide member in said dissolving tank for guiding the supplied solid processing agent to said collecting section;

said dissolving tank having a suction port and a first jetting port;

a circulator for sucking said solution through said suction port from said dissolving tank and for discharging the solution through said first jetting port into said dissolving tank, wherein said first jetting port is at a position corresponding to said collecting section whereby said solution is jetted toward said solid processing agent collected by said collecting section;

a first table;

a second table connected to said first table at a connected edge, said second table including a receiving member on which said solid processing agent is mounted, a movable supporting member for supporting said first table and said second table;

a guide member for guiding said movable supporting member, said second table rotating upwardly together with said first table when said solid processing agent is supplied through said supplying port into said dissolving tank, and said second table rotating downwardly around said connected edge when said solid processing agent is mounted on said receiving member.

6. An apparatus for dissolving solid processing agent for photographic light-sensitive material comprising:

a dissolving tank in which a solution is stored, said dissolving tank provided with a supplying port through which said solid processing agent is supplied into said dissolving tank, said dissolving tank having a second jetting port, a jetting speed from said first jetting port being faster than that from said second jetting port;

a collecting section provided in said dissolving tank, for collecting the supplied solid processing agent;

a guide member in said dissolving tank for guiding the supplied solid processing agent to said collection section;

said dissolving tank having a suction port and a first jetting port;

a circulator for sucking said solution through said suction port from said dissolving tank and for discharging the solution through said first jetting port into said dissolving tank, wherein said first jetting port is at a position corresponding to said collecting section whereby said solution is jetted toward said solid processing agent collected by said collecting section; and said apparatus adapted to provide a jetting speed of said solution from said jetting port of 40 cm/sec. to 60 cm/sec.

* * * * *